United States Patent [19]

Dunn

[11] Patent Number: 4,983,417

[45] Date of Patent: Jan. 8, 1991

[54] METHOD OF WAXING SHUFFLEBOARD DISCS

[76] Inventor: Joseph S. Dunn, 13611 Warbler Dr., Fort Myers, Fla. 33908

[21] Appl. No.: 407,128

[22] Filed: Sep. 14, 1989

[51] Int. Cl.[5] ..... B05D 1/00

[52] U.S. Cl. ..... 427/11; 118/500

[58] Field of Search ..... 118/76, 500, 503; 427/11

[56] References Cited

U.S. PATENT DOCUMENTS 4,308,633 1/1982 Van Huffel et al. ..... 427/11 X 4,621,428 11/1986 Fakumura et al. ..... 15/97 R 4,783,870 11/1988 Yeung ..... 15/210

*Primary Examiner*—Michael Lusignan

*Attorney, Agent, or Firm*—Alfred E. Wilson

[57] ABSTRACT

Shuffleboard pucks are made of wood or plastic, and to gain maximum control over the puck it is common practice to wax the underside of the pucks, thereby insuring uniformity in the travel of the pucks over the court. This waxing of the puck is done by hand, holding the wax in contact with the puck. I have found a better way to do it by using an electric motor to rotate the puck in contact with a block of wax that is hand held. The outer edge of the puck has a tendency to receive more wax than does the inner edge because the outer edge of the puck travels a greater distance in contact with the hand held wax than does the inner areas. To overcome this I have devised an arrangement whereby the wax block is triangularly shaped to deposit a uniform coating of wax dependent on the distance from the center to deposit a uniform coating of wax over the entire area.

2 Claims, 2 Drawing Sheets

FIG.3
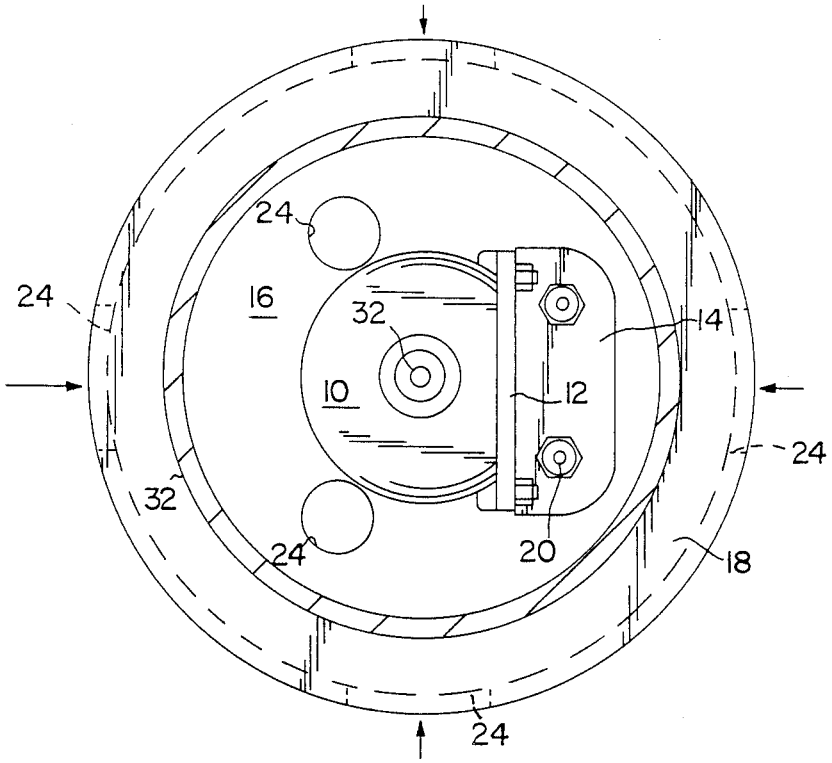
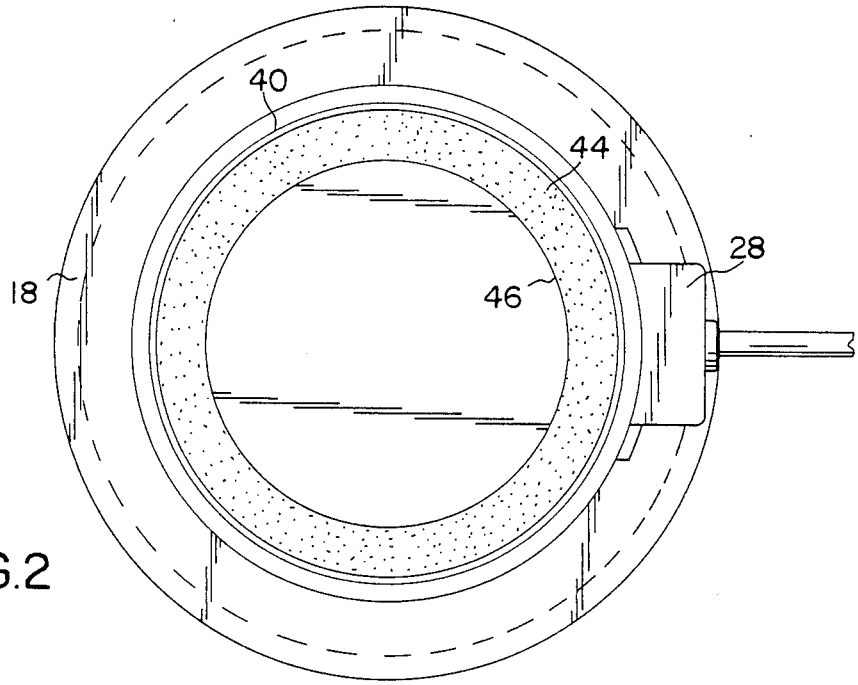
FIG.2

METHOD OF WAXING SHUFFLEBOARD DISCS

BACKGROUND OF THE INVENTION

Where the waxing of the running surface of the puck is done by hand, it is difficult, if not impossible, to apply the wax uniformly over the full area of the court contacting surface of the puck. As the game is played the players cast several pucks. While it is difficult to apply the wax uniformly to the running surface of a single puck, in instances where the waxing is done by hand it is virtually impossible to apply the wax uniformly over the outer and inner areas of the puck. By waxing the pucks by a power driven waxer I am able to insure a very high degree of uniformity of the waxing where the application of the wax is controlled in accordance with the radial distances of the puck from the center of the pucks to apply equal waxing of the pucks dependent on the distance the various areas of the puck are from the centers of the pucks to control the waxing by applying wax uniformly in accordance with the linear speed of the various areas of the puck.

FIELD OF THE INVENTION

The popularity of the game of shuffleboard is growing, and its popularity will increase more rapidly as the uniformity of waxing of the pucks becomes more common. As the uniformity of the waxing of the pucks expands, the skill and dexterity of the players becomes of greater importance.

DESCRIPTION OF THE PRIOR ART

Insofar as I know no one has devised a waxer capable of applying uniformity in the application of the wax over the entire area of the contact of the puck with the area of the court over which the pucks travel as the game progresses.

SUMMARY OF THE INVENTION

By providing a waxer that applies a uniform coating of wax to the overall contacting area of a puck in a shuffleboard game the degree of human skill becomes of greater importance.

BRIEF DESCRIPTION OF THE DRAWINGS

FIG. 2 is a sectional view taken substantially on the line 2—2 of FIG. 1, looking in the direction of the arrows.

FIG. 3 is a sectional view taken substantially on the line 3—3 of FIG. 1 looking in the direction of the arrows.

DESCRIPTION OF THE PREFERRED EMBODIMENT

Figure 1:
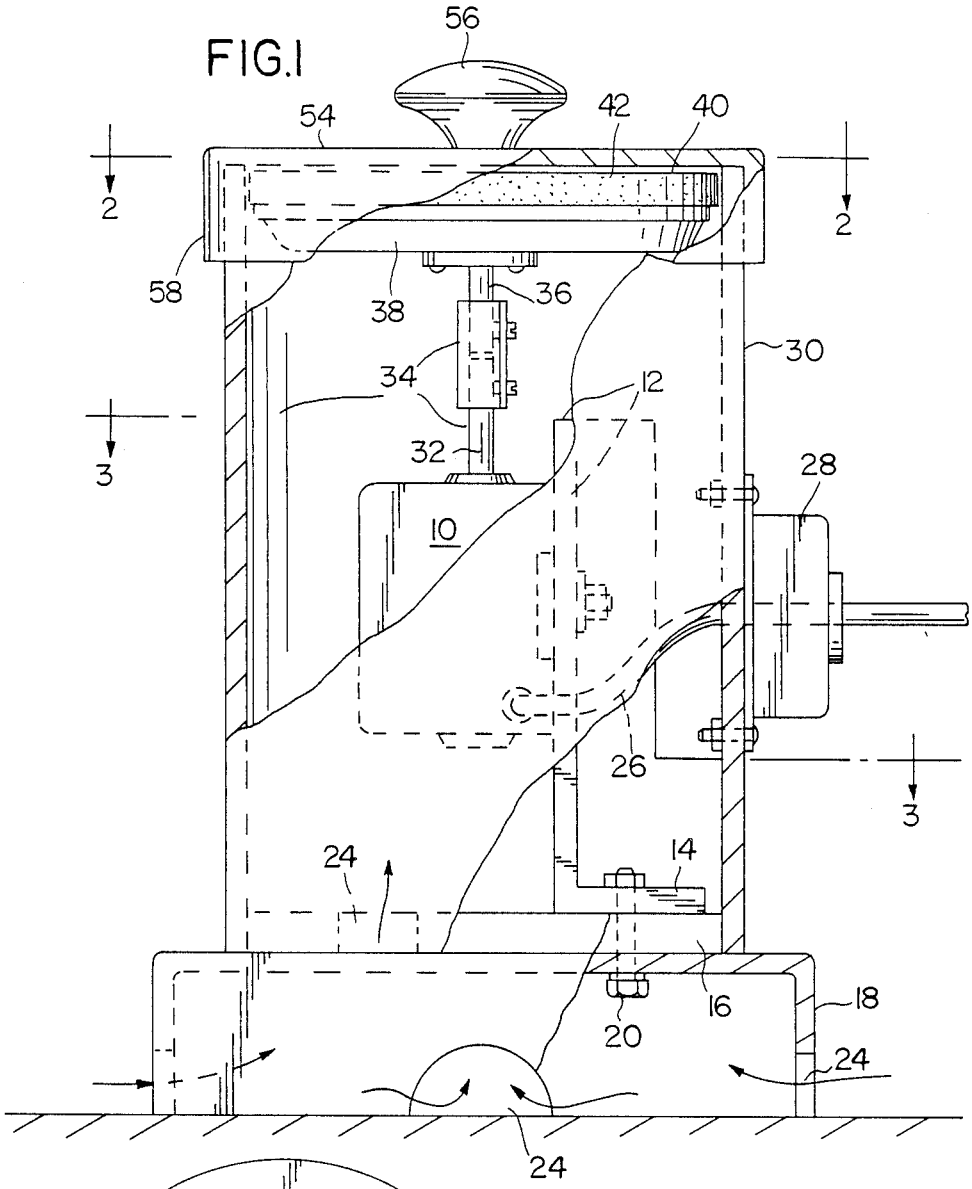
FIG. 1 is a side elevation, partly in section, of a waxer whereby substantially a uniform application of wax can be applied to the puck used in the shuffleboard game.
Figure 4:
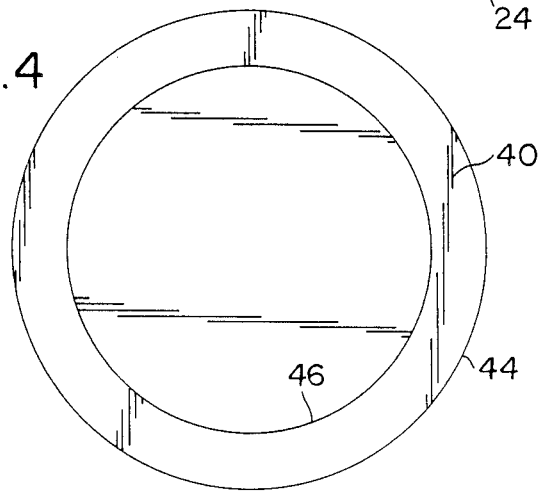
FIG. 4 is a plan view of the puck.

Referring now to FIG. 1 a driving electric motor 10 is secured to an upright flange 12 having a footer 14 set at a 90 degree angular relation to the flange 12. The footer 14 is mounted on a base 16 and an inverted box 18 by a plurality of bolts 20. The inverted box has a plurality of apertures 24 to permit cooling air to enter to maintain the motor 10 within the proper operating temperatures.

The driving motor 10 is supplied with electric current to drive the motor by a lead wire 26 connected to a terminal box 28 secured to a cylindrical container 30.

The motor 10 is mounted vertically in the cylindrical container 30, and has a driving shaft 32 connected by a connector 34 with a stem shaft 36 operably connected to a puck supporting and rotating member 38. The puck 40 is loosely mounted on the supporting member 38 in such a manner that a slight degree of lateral movement is permitted. A thin rubberized member may be interposed between the puck supporting member 38 and the puck 40.

The majority of pucks used in the Shuffleboard game are donut shaped having an outer diameter 44 of approximately 6" and an inside diameter 46 of approximately 5".

It is possible for an experienced waxer to hold a cake of wax and move it in and out readily, and thus apply a substantially uniform coating of wax to the upper surface 42 of the puck 40 that contacts the court during the playing of the game.

In view of the fact that in order to provide a uniform thickness or coating of wax over the entire area 42 being waxed it is necessary to apply more wax at the outer periphery 44 because the circumferential length is greater at the out periphery 44 than it is at the inner periphery 46.

Figure 5:
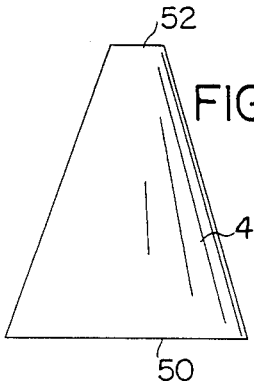
FIG. 5 is a plan view of a piece of wax shown in an exaggerated scale to apply substantially uniform waxing of the puck regardless of the distance from the center of the puck.

In order to insure uniform waxing I have arranged to use a triangular piece of wax 48 shown in an exaggerated view in FIG. 5 having a greater periphery or length of wax at the outer periphery 50 than at the inner edge 52 thereof. While using a block of wax of this triangular shape substantially the same volume of wax will be deposited over the entire area 42 to be waxed, assuming that the block is pressed with the same pressure, and that the outer edge 50 of the block 48 is applied to the outer periphery 44 of the area 42 being waxed and the shorter end 52 of the block of wax 48 is applied to the inner periphery 46 of the area 42 being waxed.

To insure relatively uniform waxing of the court contacting surface of the puck, the block 48 of wax illustrated in FIG. 5 has inner and outer circumferential lengths 52 and 50 that are proportional to the inner and outer circumferences of the donut shaped puck. It will be apparent that these dimensions are exaggerated for illustrative purposes. When the waxer is not in use a cover 54 having a central handle 56 and a downwardly extending flange 58 to overlie and being a relatively close fit over the upper edge of the cylindrical container 30.

The shuffleboard game is gaining rapidly in popularity. As the use of the more accurate method of waxing the pucks gains in popularity the popularity of the game will increase more rapidly because with better waxing the skill of the players will have a greater effect on the game.

In the operation of the shuffleboard game, if the court is smooth, the puck will travel a straight course to the target area. The small forward triangular area scores 10 points and the areas behind score lesser amounts with a penalty area behind the scoring area.

I claim:

1. The method of waxing the court contacting surface of a donut shaped shuffleboard puck, which comprises the steps of using an electric motor to rotate the puck about a vertical axis with the court contacting surface of the puck exposed, and applying wax to the exposed surface of the puck.

2. The method defined in claim 1 wherein wax is applied substantially uniformly to the court contacting surface of the puck by impressing a triangularly shaped block of wax to the court contacting surface of the puck wherein the block of wax has inner and outer circumferential lengths that are proportional to the circumferential lengths of the inner and outer circumferences of the donut shaped puck.

* * * * *